US006210500B1

(12) United States Patent
Zurfluh

(10) Patent No.: US 6,210,500 B1
(45) Date of Patent: Apr. 3, 2001

(54) METHOD OF HEAT TREAT HARDENING THIN METAL WORK PIECES

(75) Inventor: Thomas O. Zurfluh, Evanston, IL (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/428,951

(22) Filed: Nov. 4, 1999

(51) Int. Cl.[7] ..... C21D 9/00
(52) U.S. Cl. ..... 148/646; 148/658
(58) Field of Search ..... 148/645, 646, 148/647, 658; 266/130, 133, 264

(56) References Cited

U.S. PATENT DOCUMENTS

| | | | | |
|---|---|---|---|---|
| 3,510,367 | * | 5/1970 | Berger | 148/647 |
| 3,589,697 | * | 6/1971 | Hays et al. | 148/647 |
| 4,057,230 | * | 11/1977 | Hays et al. | 148/647 |
| 4,196,913 | | 4/1980 | Oka . | |
| 4,721,315 | | 1/1988 | Ueta . | |
| 5,310,196 | | 5/1994 | Kawaguchi et al. . | |
| 5,460,387 | | 10/1995 | Miyaoh et al. . | |
| 5,580,065 | | 12/1996 | Ueta . | |
| 5,695,200 | | 12/1997 | Diez et al. . | |
| 5,700,016 | | 12/1997 | Miyaoh et al. . | |
| 5,725,223 | | 3/1998 | Yamada et al. . | |
| 5,727,795 | | 3/1998 | Plunkett . | |

FOREIGN PATENT DOCUMENTS

| | | | | |
|---|---|---|---|---|
| 528 698 B1 | | 2/1993 | (EP) . | |
| 59-70715 | * | 4/1984 | (JP) | 148/658 |
| PCT/GB96/01233 | | 5/1996 | (WO) . | |

* cited by examiner

*Primary Examiner*—Deborah Yee
(74) *Attorney, Agent, or Firm*—Reising, Ethington, Barnes, Kisselle, Learman & McCulloch, P.C.

(57) ABSTRACT

A heat treat fixture is provided for supporting thin sheet-like work pieces, such as metal gasket layers, during heat treatment to achieve uniform hardness and properties of the work piece while preventing warpage. The fixture has porous, planar support walls that engage the opposite sides of the work piece. The walls include a coarse porous exoskeleton of expanded metal and an inner liner of wire mesh panels that are considerably finer than the coarse exoskeleton. The porous walls permit liquid heating and cooling media during heat treatment to flow freely through the walls for intimate contact with the work piece to achieve rapid uniform heating and cooling. The work piece is supported by the porous walls against movement out of its plane while being permitted to expand and contract within its plane to minimize warpage.

7 Claims, 5 Drawing Sheets

METHOD OF HEAT TREAT HARDENING THIN METAL WORK PIECES

BACKGROUND OF THE INVENTION

1. Technical Field

This invention relates generally to heat treat fixtures and methods for supporting thin sheet metal work pieces during heat treatment in liquid heating and cooling media to achieve hardening of the work pieces.

2. Related Art

The heat treatment of thin sheet-like structures such as metal gasket layers and the like is generally avoided in favor of the usage of pre-hardened materials such as 301 full hard stainless steel (FHSS) in the case of metal gasket layers. 301 FHSS starting material is roll hardened and possesses the desired end hardness and strength needed for metal gasket applications, which typically include one or more active layers formed with bead embossments that project out of the plane of the gasket layer and serve when compressed to provide a resilient seal between adjoining clamped structures such as a head and block of an engine. The bead embossments are typically stamped in an initially flat sheet of 301 FHSS via a stamping operation and, as such, the selection of material for the active layers must be sufficiently ductile to allow for such formation of the beads, yet sufficiently hard and strong in use to withstand considerable loading and deformation without cracking or yielding plastically under load.

It is generally accepted that the approach of heat treat hardening such thin sheet-like work pieces fabricated of less expensive heat treat hardenable materials, while attractive from a cost standpoint, is impractical at best, since such sheet-like structures having a considerably large surface area together with an extremely thin cross section (for metal gasket layers, typically on the order of about 0.01 inches) and are, by their nature, inherently unstable in a heat treat environment and would have a tendency to warp beyond levels acceptable in metal gasket applications when exposed to the extreme and rapid changes in temperature required to achieve heat treat hardening of the material.

Known approaches to controlling the warpage have involved constraining the thin sheets between two plates to prevent all movement of the sheet both against movement within its plane and out of its plane. Such approaches are not known to have been successful at preventing warpage and would likely worsen the condition by setting up non-uniform heating and cooling rates across the surface of the work piece which would contribute further to resultant warpage.

U.S. Pat. No. 5,310,196 discloses provision of a heat treat gasket layer, but the disclosure is silent as to the particulars of the heat treat process, including any fixturing of the parts, to achieve hardening while preserving the dimensional stability of the work pieces.

Accordingly, there is a need in the industry for a heat treat process and fixture apparatus capable of achieving effective, practical heat treat hardening of thin sheet work pieces such as metal gasket layers while preventing warpage of such work pieces that is prevalent using known conventional heat treatment and fixturing techniques.

SUMMARY OF THE INVENTION

According to one aspect of the invention, a fixture apparatus is provided for supporting at least one thin, planar sheet metal work piece fabricated of heat treat hardenable alloy during a heat treat cycle wherein the work piece is immersed in a first bath of liquid heating medium for heating the work piece to an elevated temperature followed by immersion in at least one bath of liquid cooling medium to quickly lower the temperature of the work piece to effect heat treat hardening of the work piece. The fixture apparatus comprises at least a pair of rigid support walls having oppositely disposed inner support surfaces that are substantially planar to define an envelope therebetween for the accommodation of at least one of such work pieces between the walls. The walls are coupled in such manner as to engage opposite sides of the work piece with the inner support surfaces in such manner as to support the work piece against movement out of its plane while permitting unrestricted movement of the work piece within its plane during the heat treat cycle. The walls are substantially porous to permit the free flow of the liquid heating and cooling medium through the walls for intimate contact with the work piece to achieve rapid uniform heating and cooling of the work piece, with the porosity being generally uniform across the support surfaces of the walls.

According to another aspect of the invention, a method is provided for heat treat hardening thin planar sheet metal work pieces fabricated of heat treat hardenable metal. The method comprises disposing the work piece in a fixture between opposing porous support walls thereof in such manner as to support the work piece against movement out of its plane while permitting the work piece to move within its plane. The fixture and work piece are immersed in a first bath of liquid heating medium which is permitted to flow through the porous walls of the fixture and intimately contact and uniformly heat the work piece to an elevated temperature. The fixture and work piece are then removed from the first bath and immersed in a second bath of liquid cooling medium which is permitted to flow through the porous walls of the fixture and intimately contact and uniformly cool the work piece to effect heat treat hardening of the work piece. Within the fixture, the work piece is substantially free to expand and contract within its plane during heating and cooling while being supported by the porous walls against movement out of its plane to prevent warpage of the work piece.

The invention has the advantage of providing a simple, effective means of heat treat hardening thin sheet-like work pieces such as metal gasket layers while avoiding the warpage problems associated with known conventional heat treatment and fixturing techniques.

The subject fixture and method enables less expensive materials to be used in thin metal layer applications, and particularly metal gasket layers. The use of such heat treat hardenable materials further reduces manufacturing costs by simplifying the formation of the usual bead embossments. Such materials are initially soft and readily deformable, requiring significantly lower stamping loads needed to form the embossments as compared to the force required to form such embossments in 301 FHSS starting material. The soft starting material further allows for greater design flexibility in the formation of the bead embossments, as there is not the concern for cracking the material.

The heat treat cycle has the added benefit of relieving any undesirable stresses that may have built up in the formation of the bead embossments that could contribute to early fatigue and failure of the gasket layer sometimes associated with full hard gasket layers.

The subject invention has the further advantage of enabling such work pieces to be austempered without warpage to achieve a desirable bainitic microstructure.

BRIEF DESCRIPTION OF THE DRAWINGS

These and other features and advantages of the present invention will be more readily appreciated by those skilled in the art when considered in connection with the following detailed description and drawings, wherein.

DETAILED DESCRIPTION

Figure 1:
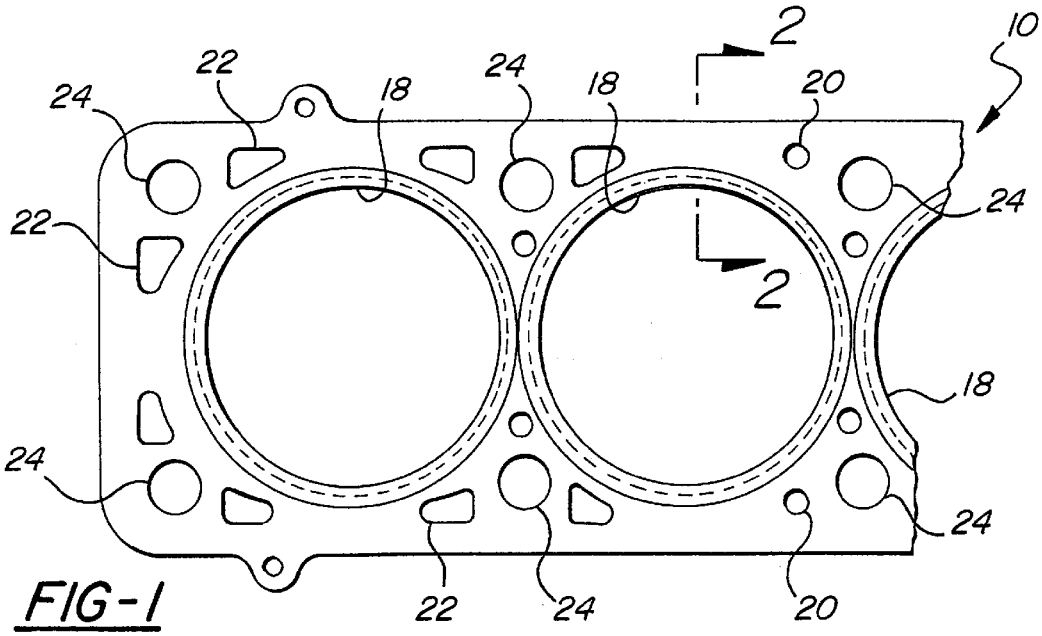
FIG. 1 is a fragmentary plan view of a metal gasket incorporating at least one thin sheet layer prepared according to the invention.

Turning now in more detail to the drawings, FIG. 1 illustrates a metal gasket 10 which incorporates at least one thin metal sheet layer 26 prepared according to the invention.

The invention will be described in relation to the preparation of the gasket layer 26 as being representative of the general type of thin, sheet-like work pieces 26 to which the invention is directed, and particularly the fixturing and heat treatment of such thin work pieces 26 to achieve hardening. Such thin work pieces 26 are characterized by having extremely thin cross sections together with considerably large surface areas. A typical gasket layer 26, for example, has a thickness of about 0.01 inches and a width and length measurements that are many times that of the thickness measurement (e.g., 3 to 5 inches wide by 8 to 20 inches long). Such imbalance in the area and cross section dimensions makes such work pieces dimensionally unstable and prone to warpage when subjected to extreme rapid changes in temperatures, such as that which occurs during conventional heat treat cycles. The present invention overcomes these deficiencies and solves the warpage problem of such work pieces by providing appropriate fixturing and controls to preserve the dimensional stability of such work pieces during a heat treat cycle to achieve desirable heat treat hardening without warpage.

Figure 2:
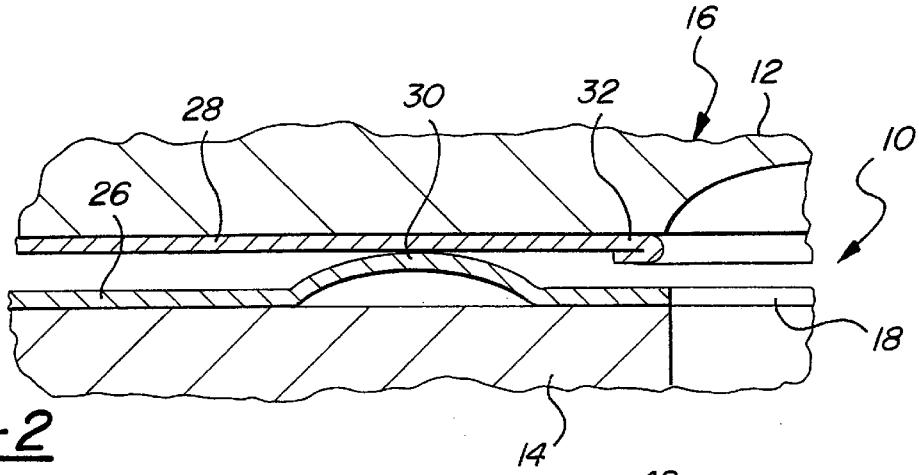
FIG. 2 is an enlarged cross-sectional view taken generally along lines 2—2 of FIG. 1.

Referring to FIG. 2, the metal gasket 10 is of the type for use in sealing a gap between mating surfaces of two stationary components, such as a cylinder head 12 and a cylinder block 14 of an internal combustion engine 16 to prevent the leakage of fluids therebetween. The gasket 10 is formed with at least one and preferably a plurality of openings, including cylinder openings 18, oil and coolant openings 20,22, and bolt hole openings 24.

The metal gaskets may be formed from one or multiple steel layers. FIG. 2 illustrates a multiple layer metal gasket construction including the layer 26 which is the active layer and an adjacent stopper layer 28. The active layer 26 is generally planar and is formed with at least one and typically a plurality of ridge-like embossments or sealing beads 30 circumscribing at least one of the cylinder openings 18, as is usual for metal gaskets.

According to the invention, the material for the gasket layer 26 is one that is hardenable through heat treatment, as opposed to full hard starting materials often used for the active layer of metal gaskets, such as 301 FHSS. By heat treat hardenable, it is meant that the material can achieve a hardness greater than the hardness when in an annealed condition by means of heating the material to an elevated temperature to place certain hardening constituents in solution, followed by a controlled quench to bring some or all of the constituents out of solution in a form that results in a relatively harder microstructure than that prior to heat treatment.

According to a preferred embodiment, such thin layers 26 prepared by the invention are fabricated of austemper-hardenable steel. Such steels have the distinguishing characteristic of being able to be isothermally transformed at a temperature below that of pearlite formation and above that of martensite formation to yield a microstructure that is substantially bainitic. The heat treatment process generally involves first heating the layer 26 of such material to an elevated temperature within the austenitizing range (typically in the range of about 1450–1600° F.), and then rapidly quenching the layer 26 in a molten salt bath maintained at a constant austempering temperature (typically in the range of about 500–750° F.) and holding for sufficient time to allow the austenite to transform to bainite.

Such an austempered layer 26 possesses a high hardness that is comparable to or exceeds that of full hard layers (in the range of about HRC 37–55), ductility or notch toughness 2 to 3 times that of full hard materials (impact strength in the range of about 40–45 ft.-lb.), tensile strength in the range of about 1300–1800 Mpa, and increased fatigue strength equal to about ½ the tensile strength versus ⅓ for fill hard stainless steel materials.

Figure 9:
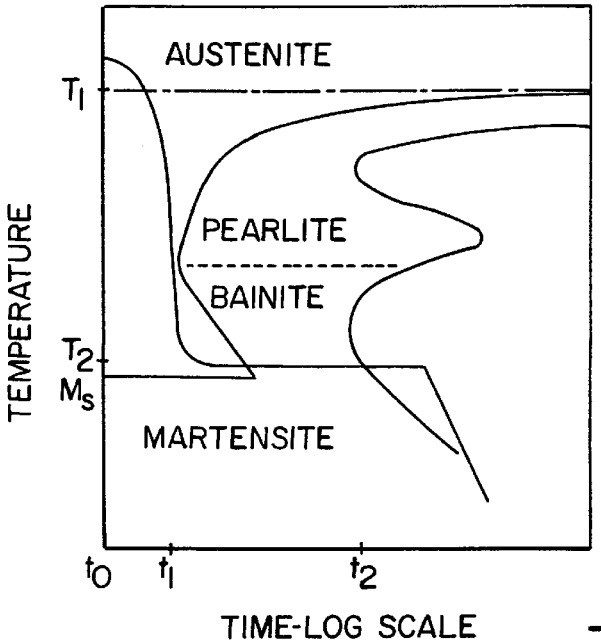
FIG. 9 is a TTT diagram and cooling curve of a representative austemper-hardenable work piece material.

The selection of steel for austempering is based largely on the time-temperature-transformation (TTT) characteristics of the particular material. FIG. 9 illustrates a schematic TTT diagram for a representative austemper-hardenable steel showing characteristics which favor austempering for candidate steels. Important considerations in the selection of austemper-hardenable steels include (a) the location of the nose of the TTT curve and the time available for bypassing it, and (b) the time available for complete transformation of austenite to bainite at the austempering temperature.

A representative cooling curve for achieving austempering is also shown on the TTT diagram of FIG. 9. The gasket layer of austemper-hardenable steel is initially heated to the austenitizing temperature $T_1$ and held for a sufficient time to austenitize the material at the commencement of the heat treat cycle, $t_0$. The austentized layer is then rapidly quenched from the austenitizing temperature $T_1$ to the austempering temperature $T_2$ in sufficient time $t_0$–$t_1$ bypass the nose of the TTT curve. The layer is held at the austenitizing temperature $T_2$ for sufficient time $t_1$–$t_2$ to achieve isothermal transformation of the austenite to bainite. Upon complete or nearly complete transformation, the layer is cooled to room temperature.

It will be seen from the TTT diagram of FIG. 9 that the nose of the TTT curve is to the right of time zero to at time $t_1$ with there being sufficient time $t_0$–$t_1$ (on the order of 2–10 seconds) in which to cool the layer to the austempering temperature $T_2$ quickly enough to bypass the nose of the TTT curve, preventing the transformation of austenite to pearlite that occurs above the nose. It will also be seen that the time for complete transformation to bainite, $t_1$–$t_2$ is within a reasonable time frame for production considerations (i.e., on the order of a few minutes to a several minutes, as opposed to several hours to several days which would be impractical).

Materials that would not be suitable candidates for austemper-hardenable steels of the invention include those in which the nose of the TTT curve is too far left so as to provide too little or no time for bypassing the nose of the TIT curve on cooling, and those with an extremely long transformation time for completion.

Examples of commercially available austemper-hardenable SAE grades of steel that are suitable candidate materials for the gasket layers of the invention include (a) generally, plain carbon steels having a carbon content between 0.50 to 1.00 wt %, including 1050, 1074, 1080, and 1095, (b) generally, high carbon steels having a carbon content exceeding 0.90 wt % and having about 0.60 Mn or a little less, (c) generally, carbon steels having a carbon content less than 0.50 wt % but with a Mn content in the range from about 1.00 to 1.65 wt %, (d) generally, low alloy steels containing more than 0.30 wt % carbon such as 1141 and 1144; the series 1300 to 4000 with carbon contents in excess of 0.40 wt %, and (e) other steels such as low alloy spring steels, 4140, 4340, 52100, 6145, 9440, 410SS, and 420SS. It is to be understood that the above list is not inclusive of the possible austemper-hardenable materials that can be employed.

According to the invention, the various openings, including the cylinder openings 18, and embossments 30 are formed in the layer 26 when the austemper-hardenable material is in a soft, readily formable pre-austempered condition. The sheet material for the layer 26 is supplied or treated so that it is fully or near fully annealed prior to the performance of any deforming operations of the layer 26, including deformation of the sealing beads 30. The material in its annealed condition is comparatively soft, having a hardness in the area of about the HRB 80's (as compared to the full hard starting material for conventional stainless steel gasket layers). The material is readily deformable under comparably low coining forces in relation to the force needed to coin conventional full hard materials.

Deforming the gasket layer 26 when the material is in the annealed condition allows greater flexibility in the selection of the particular configuration and size of the sealing bead deformations 30 for a given application beyond that which would be available if working with conventional full hard stainless steel gasket layer materials. The sealing beads 30 are formed such as by pressing, hydroforming, rubber pad forming, or coining wherein the sheet material is deformed through mechanical displacement of the sheet material out of its out of its plane to yield the ridge-like sealing bead features 30.

The stopper layer 28 of FIG. 2 may likewise be fabricated of austemper-hardenable material as described above and likewise formed when in the annealed condition. The stopper layer 28 includes thickened stopper regions or stoppers 32 extending about the openings 18. The stoppers 32 have thicknesses greater than that of the layer 28 and serve to limit the amount of compression of the sealing beads 30. The stoppers 32 may be formed by simply folding the edges of the openings 18 upon themselves to yield stoppers 32 that are twice as thick as the layer 28, or the thickness may be reduced such as by swaging the material to yield a stopper height less than twice the thickness of the layer 28.

Figure 3:
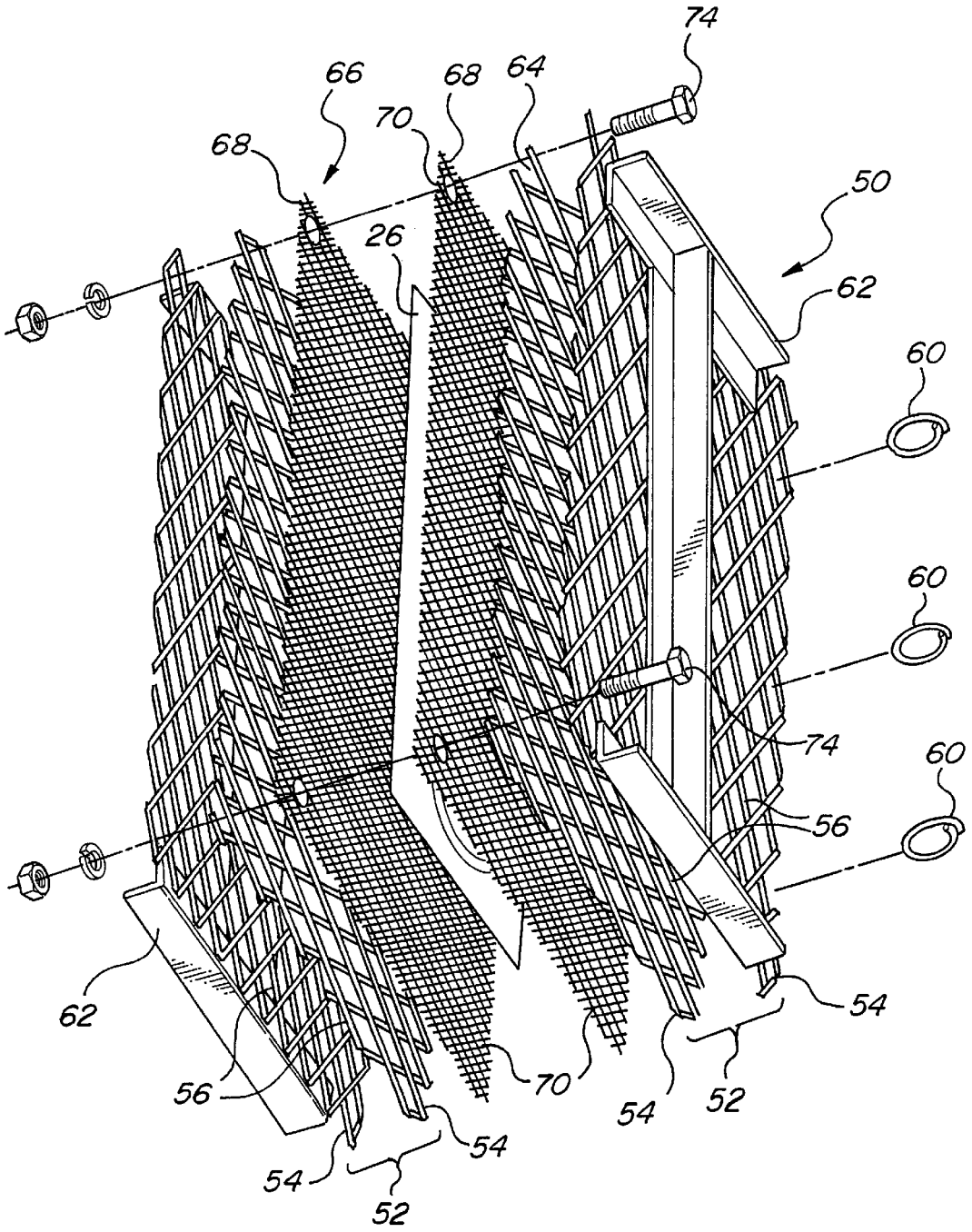
FIG. 3 is a perspective view of a first embodiment of fixture constructed according to the invention.
Figure 4:
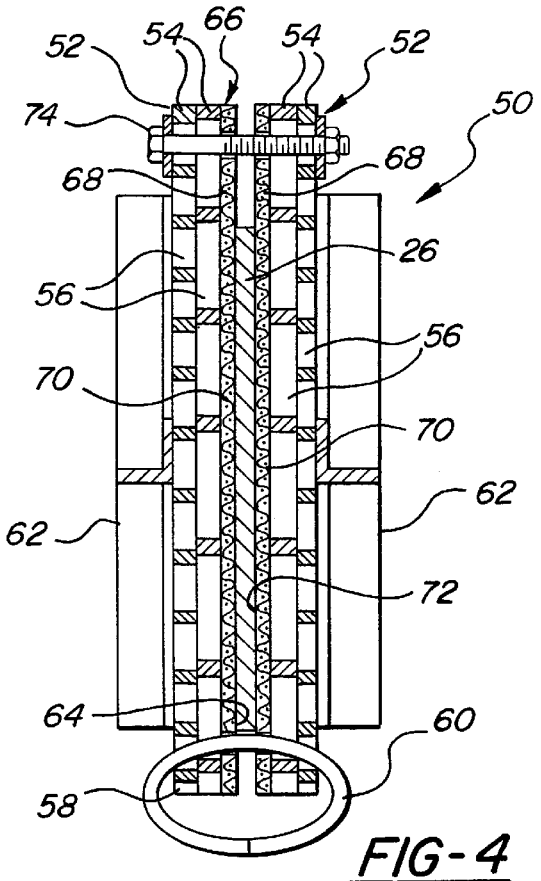
FIG. 4 is an enlarged cross-sectional view of the fixture of FIG. 3 shown supporting a thin layer.

FIGS. 3 and 4 illustrate a heat treat fixturing 50 apparatus according to a first embodiment of the invention used in forming dimensionally stable, distortion-free heat treat hardened thin layer work piece according to the invention For purposes of simplicity, reference will be made to the treatment of the active layer 26 of the gasket 10, with it being understood that the same procedure is applicable for other such thin layer metal sheet work pieces mentioned above.

Figure 5:
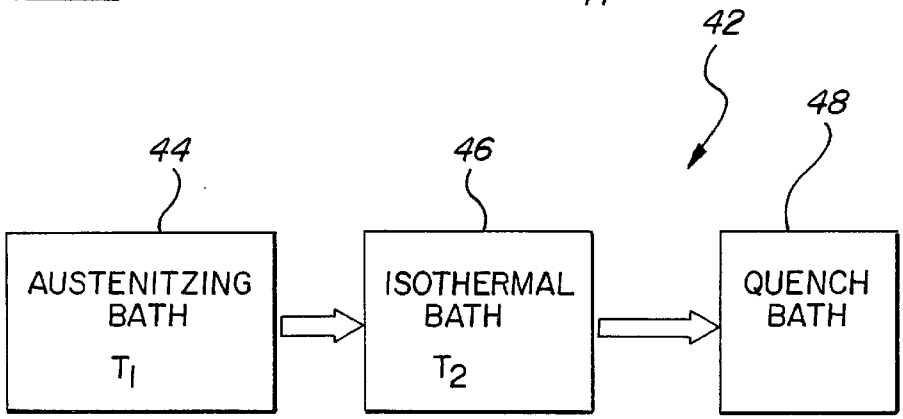
FIG. 5 is a schematic elevation view of a heat treat apparatus.

FIG. 5 schematically illustrates an austempering apparatus 42 for use in the present invention. Included is a first open top salt bath 44 in which a bath of molten salt is maintained at the austenitizing temperature $T_1$. Immediately adjacent to the bath 44 is an isothermal bath 46 in which a bath of molten salt is maintained at the austempering temperature $T_2$. Following the isothermal bath 46 is a rinse bath 48 of water kept at about room temperature.

The fixture 50 of FIGS. 3 and 4 includes porous support walls comprising a rigid exoskeleton 52 fabricated of at least two opposed outer support panels 54 of expanded metal or the like having large openings 56 to permit the free flow of molten salt therethrough from all directions (i.e., from the sides, bottom and top). Suitable material for the support panels 54 may comprise, for example, commercially available ¾ inch expanded metal, 80% open. In the illustrated embodiment, two such panels 54 are provided on each side of the fixture 50 and are supported in contact with one another.

The support panels 54 are joined adjacent the lower edges thereof in a way that secures them together, yet does not obstruct to a significant degree the ability of the molten salt media to flow freely into the fixture from the bottom or sides thereof Suitable fasteners 60, such as loops of wire or rods passing through the openings 56 of the panels may be employed for joining the panels 54, preferably with ample space between the fasteners 60 to promote maximum fluid flow. The panels 54 may be further reinforced by an external support frame 62, which may comprise lengths of angle iron or the like secured to the opposed panel sections 54 to lend structural integrity without impairing significantly the free flow of the molten salt through the panels 54. Such support of the panels 54 provides a book-like fixture with the panel halves effectively hinged along their bottom edges allowing them to be moved toward and away from one another to close and open, respectively, a space 64 defined between them.

Within the space 64 is disposed a porous liner 66. The liner 66 preferably comprises a pair of opposed inner liner panels 68 or the like having openings relatively smaller than the openings 56 of the support panels 54. The liner panels 68 preferably comprise wire cloth of a gauge and mesh considerably finer than that of the expanded metal support panels 54. The wire cloth construction of the liner panels 68 may include between 4–16 wires per inch and having a wire diameter of about 0.08 inches. The liner panels 68 may be individually secured to the inside surfaces of the inner-most support panels 54 or separately joined independent of the outer panels 54 along their bottom edges to provide the same book-like support of the liner panels 68 that enable them to pivot open and closed to define between them a fold 72 sized to receive and support the gasket layer 26.

In use, a formed gasket layer 26 is inserted from above into the fold 72 of the liner panels 68. The layer 26 may rest on the fasteners 60 to support the layer 26 from below within the fold 72. The panels 68, 54 are hinged closed and releasably secured such as by the provision of one or more additional fasteners 74 extending through the panels 68, 54 along the sides and/or top of the fixture 50 in laterally spaced relation to the layer 26, so as not to pass through or impeded lateral movement of the layer 26 within the fold 72. Inner, planar support surfaces of the liner panels 68 engage the opposite sides of the gasket layer 26 and, through reinforcement from the support panels 54 and frame 62, provide snug support to the gasket layer 26, firmly restraining the layer 26 against movement out of its plane, while permitting the layer 26 freedom to expand and move within its plane. Restraining the gasket layer 26 against movement out of its plane while permitting the layer 26 to move within its plane during heat treatment helps minimize the likelihood of warpage of the layer 26.

Once the gasket layer 26 is loaded, the fixture 50 is lowered into the first bath 44, whereupon the molten salt passes freely through the porous fixture 50 and contacts the gasket layer 26, heating the layer 26 and fixture 50 to the austenitizing temperature $T_1$. Referring to the diagram of FIG. 9, the fixture 50 is removed from the first bath 44 and lowered into the isothermal bath 46 in sufficient time to bypass the nose of the TTT curve (on the order of about 2–10 seconds). As the fixture 50 is raised from the first bath 44, the molten salt drains from the fixture 50. However, the relatively finer mesh openings 70 of the liner panels 68 provides a capillary effect which serves to retain some of the molten salt of the first bath 44 within the liner panels 68 against the sides of the gasket layer 26. The retained molten salt of the first bath 44 serves as a thermal buffer or barrier shielding the gasket layer 26 from the external environment. The molten salt barrier continually draws heat from the surrounding liners 54 and 68, serving to maintain the presence of the barrier, and thus the gasket layer 26 at or near the temperature of the first bath 44 during transport of the fixture 50 and gasket layer 26 to the subsequent isothermal bath 46. Such has the effect of prolonging the time available for bypassing the nose of the TTT curve (i.e., increases the available transportation time from the first bath 44 to the isothermal bath 46) In other words, the presence of the molten salt barrier effectively pushes the nose of the TTT curve to the right by holding the temperature of the gasket layer 26 at an austenitizing temperature during transport to the isothermal bath 46, thereby allowing for more time to reach the austempering temperature without passing through the nose of the TTT curve. The molten salt barrier further prevents the gasket layer 26 from cooling below the martensite start ME temperature during transport and further against uneven cooling across the surface of the gasket layer 26 that would contribute to warpage.

As the fixture 50 is plunged into the isothermal bath 46, the molten salt quickly enters the fixture 50 and contacts gasket layer 26, cooling it quickly to the $T_2$ austempering temperature, where it is held for sufficient time to transform the austenite to bainite. The liner 26 again serves as a thermal buffer, assuring that the gasket layer 26 is cooled uniformly so as to prevent localized hot or cold spots that would tend to warp the layer 26. Once the transformation to bainite is complete, the fixture is raised from the bath 46 and plunged into the rinse bath 48 to remove the salt.

Following austempering, the hardened gasket layer 26 is removed from the fixture 50 and further treated in the manner consistent with conventional gasket layers in the manufacture of metal gaskets. Such includes cleaning the layer 26 with a suitable detergent or etchant, coating the layer with a suitable nonmetallic coating, such as NBR, and assembling the layer 26 with other layers (in the case of a multi-layer gasket 10) according to conventional practice.

It will be appreciated that the austempering cycle relieves the gasket layer 26 from any residual forming stresses imparted to the gasket layer 26 during formation of the sealing bead 30, such that the resultant austempered layer 26 has substantially uniform strength and hardness across its surface. The same holds true for the stopper layer 28 and single layer 34 applications.

Figure 8:
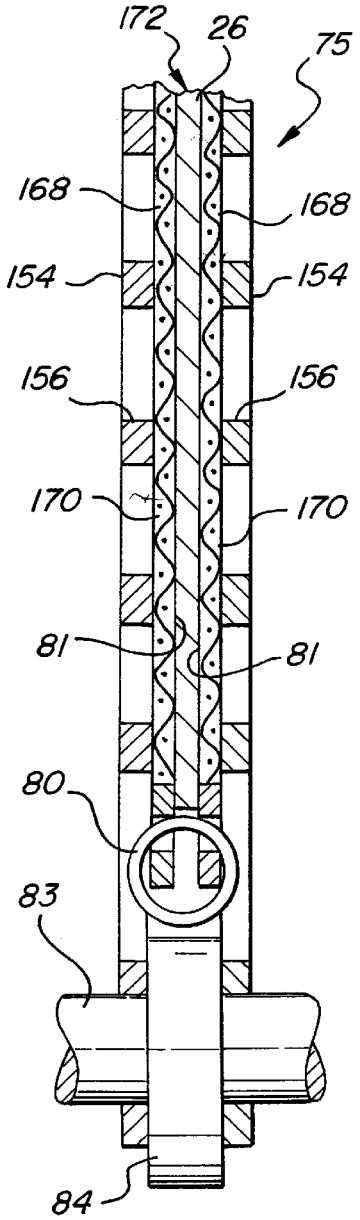
FIG. 8 is a further enlarged fragmentary sectional view of a portion of the fixture of FIG. 6 shown supporting a thin work piece layer.
Figure 6:
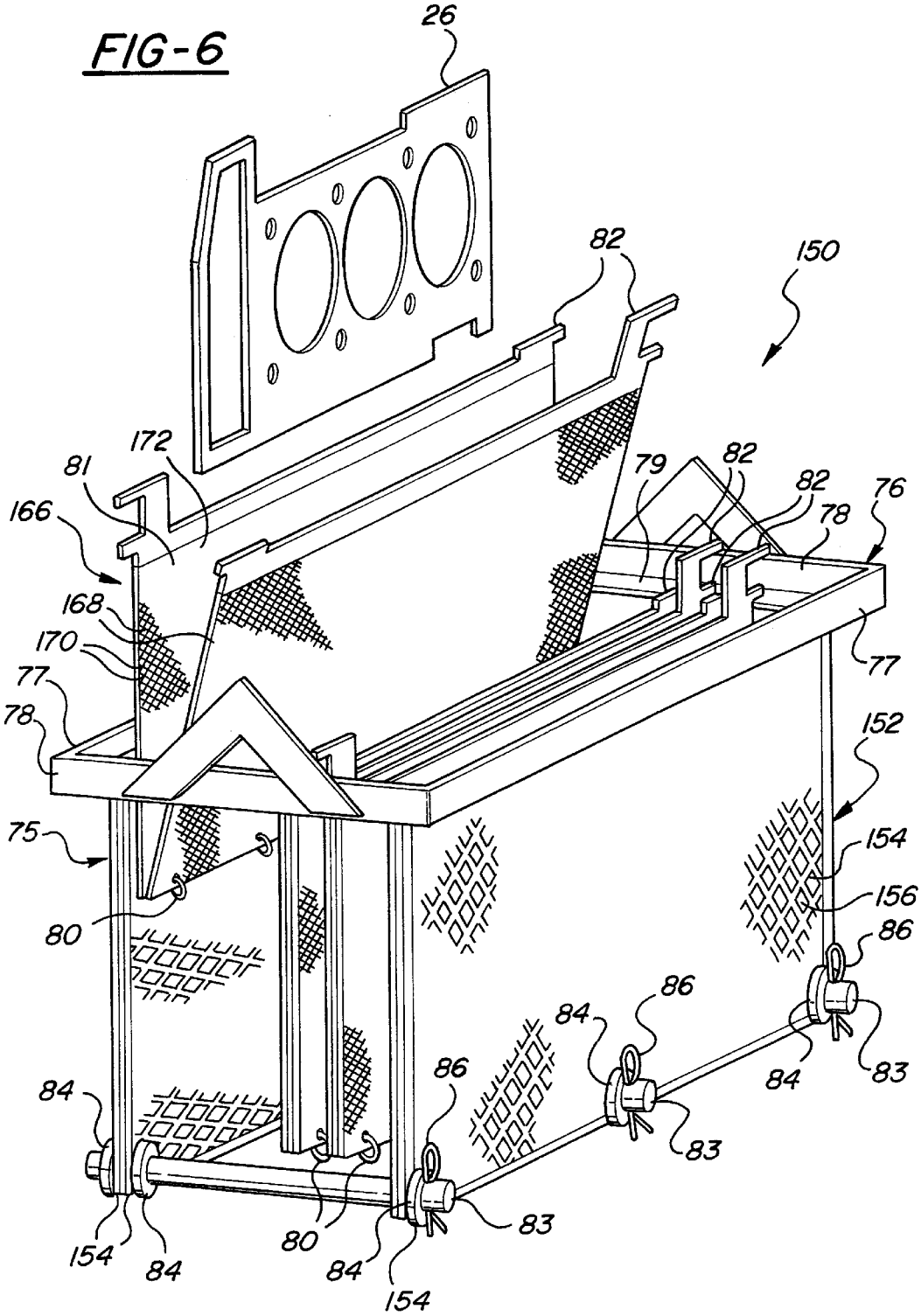
FIG. 6 is an exploded perspective view of a heat treat fixture constructed according to a second embodiment of the invention.
Figure 7:
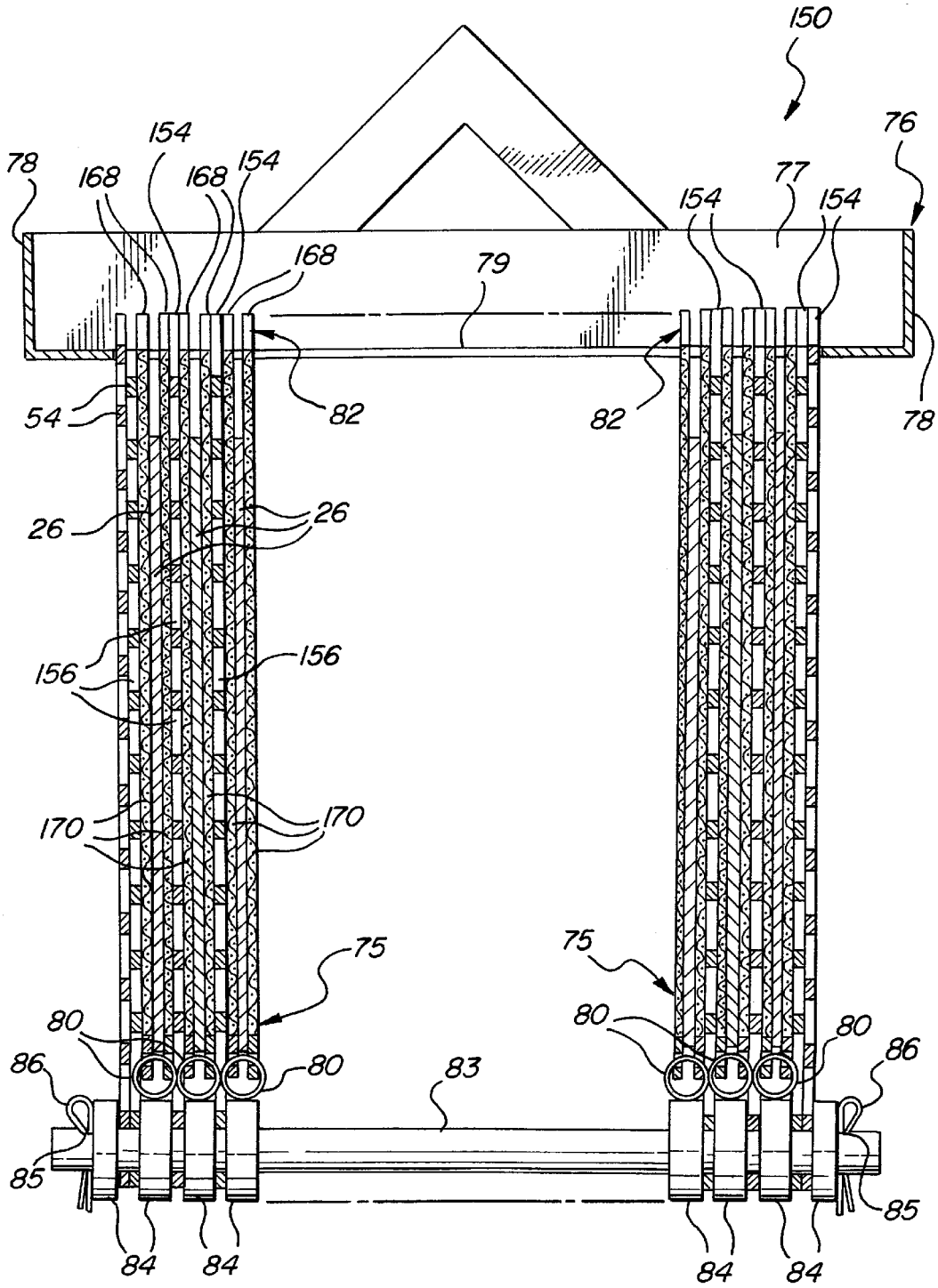
FIG. 7 is an enlarged lateral cross-sectional view of the fixture of FIG. 6.

FIGS. 6–8 illustrate a fixture apparatus 150 constructed according to an alternative embodiment of the invention, wherein the same reference numerals are used to represent like features in common with the first embodiment of FIGS. 3 and 4, but are offset by 100. The same work pieces 26 are illustrated as being supported by the fixture 150.

The fixture 150 includes at least two opposed porous support walls 75, and preferably a plurality of such walls 75, which define corresponding envelopes for the accommodation of associated work piece layers 26, with the porous support walls 75 permitting the free flow of the liquid heating and cooling medium through the walls for intimate contact with and uniform heating and cooling of the work piece layers 26, while supporting the work pieces 26 against movement out of their respective planes and permitting movement of the work pieces within their planes during such heating and cooling to minimize the occurrence of warpage.

The support walls 75 are supported by a common rigid support frame 76. The frame 76 has a generally rectangular open frame configuration and includes spaced side walls 77 joined by spaced end walls 78. The end walls 78 are preferably formed with inwardly projecting flanges or ledges 79 that serve to suspend the porous support walls 75 in the manner to be described below.

The support walls 75 include porous inner panels 168 backed by porous outer support panels 154 and are generally the same as the inner and outer porous panels 68, 54 of the first embodiment, and are preferably constructed of the same screening materials as described with respect to the first embodiment. According to the second embodiment, each pair of inner panels 168 are hinged along their lower margins by connecting wires 80 or the like, giving each pair of inner panels a hinged book-like construction having generally planar inner support surfaces 81 which engage opposite sides of the work piece 26 disposed within the envelope defined between the surfaces 81. Adjacent to each inner panel 168 is at least an associated one of the outer panels 154 which back the inner panels 168 and serve as a rigid, supportive exoskeleton that is sufficiently porous to permit the free flow of the heating and cooling media therethrough.

As illustrated best in FIGS. 6 and 7, each set of inner panels 168 is separated by an intervening outer panel 154, except at the ends of the fixture where there is provided an additional outer panel 154 for added rigidity. The outer panels 154 have hooks or hangers 82 at their upper ends that project laterally outwardly of the panels 154 and are supported by the side ledges 79 of the frame 76 so as to suspend the outer liners 154 within the frame 76. The lower ends of the outer panels 154 project below the lower margins of the inner panels 164 and are coupled at their lower margins by a plurality of transverse connecting bars or rods 83. The rods 83 pass through associated openings in the outer panels 154, enabling the panels 154 to slide on the rods 83. Washers or spacers 84 are disposed on the rods 83 between the adjacent outer panels 154 to maintain a fixed separation or spacing of the panels 154. The spacing between the outer panels 168 corresponds to the stack up thickness of the inner panels 168 and the work piece 26 disposed between each set of outer panels 154. In this way, the outer panels 154 are able to be slid toward one another so as to engage the inner panels 164, which in turn engage the work piece 26. The outer panels 154 can be secured in position so as to exert a compressive load on the inner panels 168 in order to apply sufficient force on the work piece 26 to retain it from moving out of its plane while supporting it loosely enough to enable the work piece 26 to expand and construct within its plane For this purpose, the rods 83 are formed with openings 85 adjacent their ends through which lock pins 86 or the like may be extended to force the outer panels 154 and spacers 84 together and to support the work pieces 26 in the above manner.

The plurality of support walls 75 are arranged such that there are a number of repeating units, comprising a pair of the inner liner panels 168 and at least one associated outer panel 154, such that when disposed in the frame 76, each set of inner panels 168 is separated by an outer panel 154. In practice, the work pieces 26 are loaded into the fixture 150 by first removing the hinged inner panels 168 from between the outer panels 154. The inner panels are hinged open and an associated work piece disposed therein. The inner panel sets 168 and work pieces 26 are then returned to position between the outer panels 154 and the lower ends of the outer panels 154 clamped via the spacers 84 and lock pins 86 to secure the work pieces 26 for heat treatment. Once loaded, the fixture 150 is immersed in the heating and cooling baths 46, 48 as before to effect heat treat hardening of the work pieces In the same manner as described above for the first embodiment.

The disclosed embodiments are representative of presently preferred form of the invention, and are intended to be illustrative thereof rather than definitive thereof. The invention is defined in the claims

What is claimed is:

1. A method of heat treat hardening thin planar sheet metal work pieces fabricated of heat treat hardenable metal, said method comprising:

disposing the work piece in a fixture between opposing porous support walls thereof in such manner as to support the work piece against movement out of its plane while permitting the work piece to move within its plane;

immersing the fixture and work piece in a first bath of liquid heating medium and allowing the medium to flow through the porous walls of the fixture and to intimately contact and uniformly heat the work piece to an elevated temperature; and removing the fixture and work piece from the first bath and immersing the fixture and work piece in a second bath of liquid cooling medium and allowing the medium to flow through the porous walls of the fixture and intimately contact and uniformly cool the work piece to effect heat treat hardening of the work piece, with the work piece being substantially free to expand and contract within its plane during heating and cooling while being supported by the porous walls against movement out of its plane to prevent warpage of the work piece.

2. The method of claim 1 including providing the porous support walls with a pair of porous inner panels each backed by at least one porous outer panel, with the inner panels having a relatively finer mesh opening than that of the outer panels.

3. The method of claim 1 including heating the work piece in the first bath to an austenitizing temperature and cooling the work piece in the second bath to an austempering temperature at a cooling rate and for a time sufficient to austemper the work piece.

4. The method of claim 1 including maintaining a protective envelope of the heating medium against the work piece during transport from the first heating bath to the second cooling bath to slow the cooling rate of the work piece during such transport.

5. The method of claim 4 wherein the protective envelope is maintained by constructing the support walls to include a pair of inner panels of relatively fine mesh porous screen against opposite surfaces of the work piece having openings sized to capture and retain the heating medium against the work piece when the fixture is withdrawn from the first bath.

6. The method of claim 5 including constructing the support walls to include at least a pair of outer porous support panels backing the inner panels and having a relatively coarser mesh than that of the inner panels.

7. The method of claim 6 including constructing the inner panels from relatively fine wire cloth and constructing the outer panels from relatively coarse expanded metal.

* * * * *

UNITED STATES PATENT AND TRADEMARK OFFICE

CERTIFICATE OF CORRECTION

PATENT NO. : 6,210,500 B1
DATED : April 3, 2001
INVENTOR(S) : Thomas O. Zurfluh

It is certified that error appears in the above-identified patent and that said Letters Patent is hereby corrected as shown below:

Column 4,
Line 39, change "fill" to -- full --; line 65, change "to" to -- $t_0$ --.

Column 5,
Line 12, change "TIT" to -- TTT --.

Column 7,
Line 47, change "ME" to -- $M_S$ --.

Column 9,
Line 8, change "construct" to -- contract --.
Line 28, change "In" to -- in --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*